United States Patent [19]

Kammerer et al.

[11] Patent Number: 4,564,827

[45] Date of Patent: Jan. 14, 1986

[54] PROGRAMMABLE CONTROL FOR A SWITCHING CHRONOMETER

[75] Inventors: Gerd Kammerer, St. Georgen; Friedrich X. Thoma, Haslach i. K., both of Fed. Rep. of Germany

[73] Assignee: Dieter Graesslin Feinwerktechnik, Fed. Rep. of Germany

[21] Appl. No.: 593,095

[22] Filed: Mar. 26, 1984

[30] Foreign Application Priority Data

Mar. 25, 1983 [DE] Fed. Rep. of Germany ..... 3310935

[51] Int. Cl.[4] ..... H01H 51/34

[52] U.S. Cl. ..... 335/92; 335/97; 310/168

[58] Field of Search ..... 310/168, 169, 170; 335/92, 96, 97; 307/106, 107, 108; 324/171; 368/121

[56] References Cited

U.S. PATENT DOCUMENTS

| | | | |
|---|---|---|---|
| 2,669,670 | 2/1954 | Eggers | 310/168 |
| 3,742,243 | 6/1973 | Gamble | 307/106 |
| 4,217,512 | 8/1980 | Hauler et al. | 310/168 |

*Primary Examiner*—George Harris

*Attorney, Agent, or Firm*—Hill, Van Santen, Steadman & Simpson

[57] ABSTRACT

In a programmable control means for switching timers or chronometers, a magnetic field sensor having a ferromagnetically alloyed wire is disposed on a program carrier. A coil is brought into the proximity of the wire. A permanent magnet adjacent thereto has a magnetic field which influences the core polarity of the wire such that the coil emits voltage pulses given polarity changes therein for the control of an electric or of an electronic switch. According to the invention the sensor wire is releasably disposed on the program carrier.

12 Claims, 6 Drawing Figures

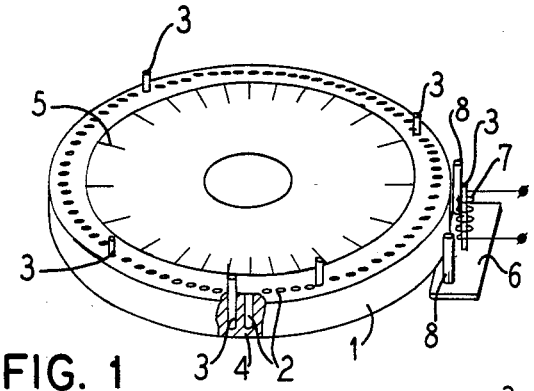
FIG. 1
FIG. 1A
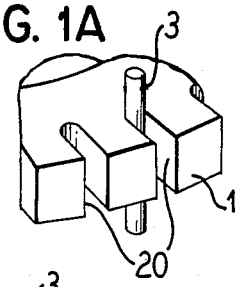
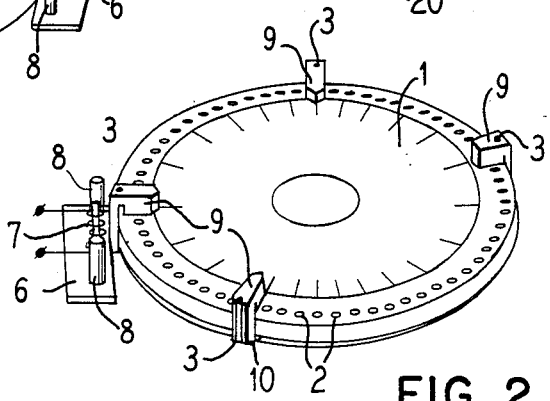
FIG. 2
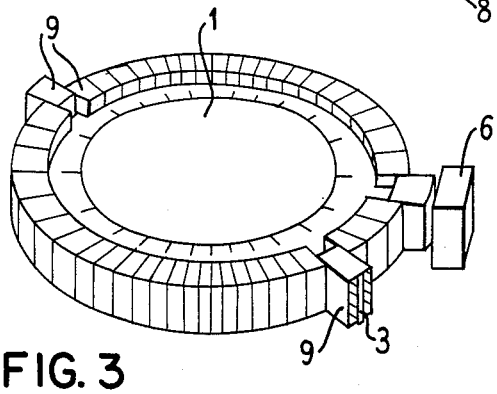
FIG. 3
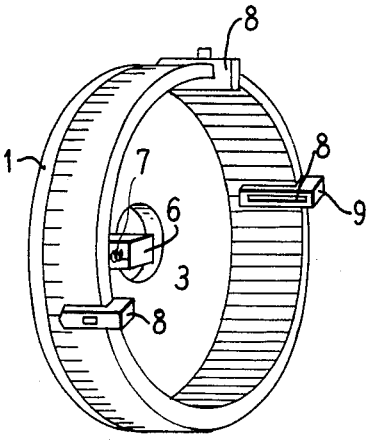
FIG. 5
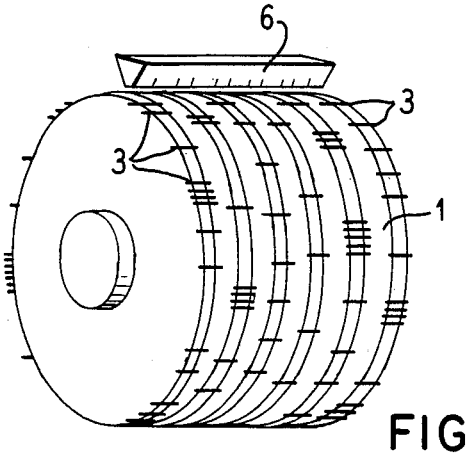
FIG. 4

PROGRAMMABLE CONTROL FOR A SWITCHING CHRONOMETER

BACKGROUND OF THE INVENTION

The invention relates to a programmable control for a switching chronometer or timer comprising a magnetic field sensor, and in particular a sensor having a ferromagnetically alloyed wire that is disposed on a program carrier. A coil is brought into the proximity of the wire. A permanent magnet adjacent thereto has a magnetic field which influences the core polarity of the wire such that the coil emits voltage pulses given polarity changes for the control of an electric or of an electronic switch means.

It is necessary given such chronometers or timers, particularly given switch clocks, cycle control timers or time lag relays to cite only a few applications for such devices, that one or more switching times can be simply and surveyably programmed with adequately fine graduations both for the desired cut-in time as well as for the desired cut-out time. It should thus be assured that a programmable control means which can not only be economically manufactured in terms of production engineering but which can also be universally and handily employed in such devices can be obtained upon employment of a magnetic field sensor whose manner of functioning is based on the known, so-called Wiegand effect.

It is known to employ such magnetic field sensors for reading programmable data storages wherein, for example given an identity card, the wires are embedded in plastic such that the wires having a specific length of approximately 15 mm are disposed axially displaced relative to one another according to a specific program pattern wherein the wires are aligned axially parallel to one another. This non-variable program pattern on such a program carrier is read by a read head which is essentially equipped with a coil and with a permanent magnet adjacent thereto. The read head or the program carrier can be linearly or rotationally moved for the purpose of reading (reprint from Elektronik, No. 7/80, incorporated herein by reference).

This known apparatus is handicapped by the disadvantage that the ferromagnetic wires impressed, injected, or bonded in the program carrier are non-releasably disposed and are thus not arbitrarily reprogrammable, particularly for the non-technician.

SUMMARY OF THE INVENTION

An object of the invention is to eliminate these disadvantages and to create a means of the type initially cited which can be simply, surveyably, economically and reliably programmed.

This object is inventively achieved in that the sensor wire is releasably disposed on a program carrier. The sensor wire in this case is preferably releasably plugged into corresponding holes or grooves on the program carrier in conformity with the switching program.

It is provided in a further development of the invention that the wire designed as a spring clip is latched to the program carrier or that the wire is entirely or only partially embedded in so-called switch riders, whereby such plastic switch riders are releasably or non-releasably, yet programmably, disposed as program carriers on a so-called index ring in a manner known per se.

With this system, there is not only a simple, rational and economic manufacture of a program carrier with programmable sensor wires, but also a simple and reliable scanning of a stationary or of a moving program carrier, particularly a time-keeping rotating program carrier, by means of a read head, known per se. The relatively finely graduated programmability of the system with approximately 0.25 mm thick wires is also advantageous.

BRIEF DESCRIPTION OF THE DRAWINGS

FIG. 1 is a schematic, partially cut view of a program carrier in its embodiment as an index ring for switch clocks having sensor wires similar to switch riders plugged on in conformity with the switching program;

FIG. 1A shows in fragmentary view the sensor wires impressed in grooves 20 at a circumference of a program carrier;

FIG. 2 is a schematic, partially cut view of a program carrier in its embodiment as an index ring for switch clocks having switch riders and sensor wires embedded in the switch riders;

FIG. 3 is a schematic, partially cut view of a program carrier in its embodiment as an index ring for switch clocks having so-called non-releasable or captive switch riders disposed on the index ring, with the sensor wires embedded therein;

FIG. 4 is a schematic view of a program carrier in its execution as a programming drum for a program cycle control timer having a plurality of sensor wires disposed relative to one another in conformity with a program in a number of planes concentrically disposed relative to one another; and FIG. 5 is a schematic view of a program carrier having, in a modification of the inventive concept, permanent magnets disposed on the program carrier in conformity with the program.

DESCRIPTION OF THE PREFERRED EMBODIMENTS

In detail, FIG. 1 shows a plastic program carrier 1 embodied as an index ring for a switch clock which is provided at its circumference with holes 2 tightly adjacent to one another and proceeding coaxially relative to one another into which ferromagnetically alloyed Wiegand effect sensor wires 3 can be plugged in conformity with the switching program. The holes 2 are preferably provided with a floor 4. A time-setting or programming scale 5 is also provided.

FIG. 1A shows the sensor wires impresed or plugged directly into grooves 20 of the program carrier 1.

The programmed sensor wires 3 are read by a read head 6 that is essentially equipped with a sensor coil 7 and with two permanent magnets 8 in close proximity to the sensor coil 7. The sensor coil 7 and the magnets 8 are closely adjacent to the sensor wires 3 which rotate past the read head 6 in a time-keeping fashion, so that the magnetic charging of the sensor wires 3 reverses their core polarity, this resulting in the fact that a voltage pulse is induced in the sensor coil 7 which can directly or indirectly serve for the control of an electric or electronic switch means that is not shown in detail.

The relatively small outside diameter of the sensor wires 3 makes it possible to achieve a relatively small distance of the wires relative to one another on the program carrier 1, this in turn leading to a very small and advantageous spacing of switching time between two mutually programmed sensor wires 3 which lies on the order of 5 minutes/24 hours when the program carrier 1 has an outside diameter of approximately 60 mm.

FIG. 2 shows a program carrier 1 embodied as a known index ring for switch clocks which is provided at its circumference with holes 2 in close proximity to one another and proceeding coaxially relative to one another in which switch riders 9 known per se can be plugged in conformity with the switching program. At their side 10 directed toward the outside, these switch riders 9 consisting of plastic are provided with a sensor wire 3 which can be impressed, bonded in, or welded on at this location. The switch riders 9 with sensor wires 3 which are disposed on the program carrier in conformity with the switching program are again read by a stationarily disposed read head 6.

The switch riders 9 are removable from the program carrier 1, i.e. they can be lost in this embodiment. As FIG. 3 shows, such sensor wires 3 can be provided in switch rider units which can in fact be programmed on a program carrier 1 but which cannot be removed from the program carrier. The switch riders of this sort are known and can be displaced to an outer program position as shown. A read head 6 is also shown.

FIG. 4 shows a program carrier 1 embodied as a program drum for a program cycle control timer, whereby a plurality of program carriers 1 are disposed concentrically relative to one another in a number of planes. Sensor wires 3 are again disposed at the circumference on the individual program carriers 1 in conformity with the switching program, said sensor wires 3 being sensed by corresponding read heads 6 and being allocated to each program carrier 1. It is thus possible that all program carriers 1 can rotate with the same speed, i.e. are coupled to one another. It is also possible, however, that indivudual program carriers can have rotational speeds differing from one another.

The sensor wires 3 can be impressed, injected, or bonded to the circumference of the program carriers 1. They can be directly applied there to the circumferential surface or can be pressed into special grooves disposed at specific, tight intervals relative to one another, said grooves proceeding coaxially relative to one another. The sensor wires 3 in this case can be longer than the individual thicknesses of the program carriers 1.

FIG. 5 shows a program carrier 1 wherein, in a modification of the inventive concept, permanent magnets 8 are disposed on the program carrier 1 in conformity with the switching program instead of the sensor wires 3. In this case, the sensor wire 3 is integrated with the sensor coil 7, i.e. the sensor coil 7 is wound on the sensor wire 3 in a known manner. This special embodiment of a program carrier 1 having a special read head 6 is more meaningful and economical for certain uses than the embodiments described above, particularly since the sensor wires 3 are relatively expensive and it is often sufficient to dispose a magnet 8 in conformity with the switching program directly on a program carrier 1 or indirectly thereon via a switch rider. Further, it is expedient in certain dynamic position and angle measuring devices in the framework of switching chronometers or timers to move the magnet system, particularly when the magnet system can be manufactured by means of injection technology.

Although various minor modifications may be suggested by those versed in the art, it should be understood that we wish to embody within the scope of the patent warranted hereon all such modifications as reasonably and properly come within the scope of my contribution to the art.

We claim as our invention:

1. A switching timer programmable control means, comprising:
   - a movable program carrier;
   - a magnetic field sensor comprising a ferromagnetically alloyed Wiegand effect wire disposed on the program carrier;
   - a coil in proximity of the program carrier and the carrier being movable so as to permit the wire to be moved to a proximity of the coil during timer operation;
   - a permanent magnet adjacent the coil whose magnetic field influences a core polarity of the wire when it is in a proximity thereof such that the coil emits voltage pulses given such polarity changes in the wire for control of an electrical switch; and
   - means on the program carrier for permitting free movement of the wire to a desired program position in accordance with a desired switching program.

2. A control means according to claim 1 wherein said means on the program carrier comprises holes dimensioned so as to permit the sensor wire to be directly plugged into the holes in conformity with the desired switching program, said holes being disposed in close proximity to one another at a circumference of the program carrier and being provided parallel relative to one another.

3. A control means according to claim 1 wherein the sensor wire is plugged directly into grooves in conformity with the switching program, said grooves being disposed in close proximity to one another at the circumference of the program carrier and proceeding parallel relative to one another.

4. A control means according to claim 1 wherein the sensor wire is provided in a spring clip means designed for latching to the program carrier in conformity with the switching program.

5. A control means according to claim 1 wherein the sensor wire is at least partially embedded in a switch rider and the switch rider is programmably disposed on an index ring member serving as said program carrier.

6. A control means according to claim 5 wherein the switch rider is removable for programming.

7. A control means according to claim 1 wherein means are provided in association with the program carrier for prohibiting removal of the sensor wire yet allowing a displacement of the wire to a programmable position.

8. A control means according to claim 7 wherein the program carrier comprises a disk and said means associated with the program carrier radially displaces the sensor wire.

9. A switching timer programmable control means, comprising:
   - a rotatable circular program carrier in a disk shape;
   - a plurality of holes around a periphery of the carrier dimensioned so as to receive and hold sensor wire segments each comprising a ferromagnetically alloyed Wiegand effect wire placed in respective holes in accordance with a desired program, said holes also being dimensioned so as to permit removal of the wires for reprogramming;
   - a sensor head in proximity to the circumference of the disk shaped carrier, said sensor head comprising a permanent magnet and a coil in proximity to the permanent magnet; and the permanent magnet and sensor coil being positioned such that as the program carrier rotates and the sensor wire passes the permanent magnet, the magnetic field associated with the permanent magnet influences a core polarlity of the wire which effect is sensed by the coil which emits voltage pulses corresponding to such polarlity changes, said voltage pulses being useful for electronic switching control.

10. A programmable control means according to claim 9 wherein two permanent magnets are provided in the sensor head with the coil centrally located between the two magnets.

11. A switching timer programmable control means, comprising:

a rotatable program carrier;

movable permanent magnets having means for attachment to the movable carrier at a desired location in accordance with a desired program;

a read head in a proximity of a periphery of the movable carrier, said read head having a sensor wire comprising a ferromagnetically alloyed Wiegand effect wire with an associated sensor coil; and said program carrier being dimensioned and shaped so that as it rotates and one of the permanent magnets thereon moves by the read head, the permanent magnet causes a core polarity change in the wire which is sensed by the coil so as to create voltage pulses useful for controlling an electronic switch.

12. A switching timer programmable control means, comprising:

a rotatable circular program carrier in a disk shape;

a plurality of wire holding means holding sensor wire segments each comprising a ferromagnetically alloyed wire around a periphery of the carrier movably positionable on the carrier in accordance with a desired program;

a sensor head in proximity to the circumference of the disk shaped carrier, said sensor head comprising a permanent magnet and a coil in proximity to the permanent magnet; and the permanent magnet and sensor coil being positioned such that as the program carrier rotates and the sensor wire passes the permanent magnet, the magnetic field associated with the permanent magnet influences a core polarity of the wire which effect is sensed by the coil which emits voltage pulses corrsponding to such polarity changes, said voltage pulses being useful for electronic switching control.

* * * * *